US008418935B2

(12) United States Patent
Chen et al.

(10) Patent No.: US 8,418,935 B2
(45) Date of Patent: Apr. 16, 2013

(54) ROTARY-SPRINKLING SHOWER

(75) Inventors: Jianmin Chen, Xiamen (CN); Renzhong Li, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 136 days.

(21) Appl. No.: 13/128,115

(22) PCT Filed: Jan. 14, 2010

(86) PCT No.: PCT/CN2010/070188

§ 371 (c)(1),
(2), (4) Date: May 6, 2011

(87) PCT Pub. No.: WO2010/083742

PCT Pub. Date: Jul. 29, 2010

(65) Prior Publication Data

US 2011/0215171 A1 Sep. 8, 2011

(30) Foreign Application Priority Data

Jan. 20, 2009 (CN) ..... 2009 2 0136501 U

(51) Int. Cl.
*B05B 3/04* (2006.01)
*B05B 1/18* (2006.01)

(52) U.S. Cl.
USPC ..... 239/240; 239/237

(58) Field of Classification Search ..... 239/225.1, 239/237, 240, 242, 263.3, 380, 381, 548, 239/559, 567, 587.3, 587.4
See application file for complete search history.

(56) References Cited

U.S. PATENT DOCUMENTS

| | | | | |
|---|---|---|---|---|
| 5,294,054 | A * | 3/1994 | Benedict et al. | 239/222.15 |
| 5,397,064 | A | 3/1995 | Heitzman | |
| 5,619,766 | A * | 4/1997 | Zhadanov et al. | 15/29 |
| 5,704,547 | A * | 1/1998 | Golan et al. | 239/11 |
| 5,938,123 | A | 8/1999 | Heitzman | |
| 6,170,765 | B1 * | 1/2001 | Gil et al. | 239/539 |
| 2002/0158143 | A1 * | 10/2002 | Moriarty et al. | 239/226 |
| 2005/0263617 | A1 * | 12/2005 | Thong | 239/383 |
| 2006/0144968 | A1 * | 7/2006 | Lev | 239/590 |
| 2007/0205309 | A1 * | 9/2007 | Zhou | 239/587.1 |
| 2008/0111006 | A1 * | 5/2008 | Shieh | 239/383 |
| 2009/0321538 | A1 * | 12/2009 | Lo | 239/443 |
| 2010/0213289 | A1 * | 8/2010 | Huang | 239/587.1 |

FOREIGN PATENT DOCUMENTS

| | | |
|---|---|---|
| CN | 2734338 | 10/2005 |
| CN | 2794647 | 7/2006 |
| CN | 101585022 | 11/2009 |
| CN | 201361594 | 12/2009 |

* cited by examiner

*Primary Examiner* — Darren W Gorman
(74) *Attorney, Agent, or Firm* — Rabin & Berdo, P.C.

(57) ABSTRACT

Rotary-sprinkling shower comprises: a body which has a water inlet end and a water outlet end forming a waterway there-between; a front cover component rotatably disposed on the water outlet end of the body, equipped with water spray nozzles in communication with the waterway; a hydraulic driving unit disposed in the waterway, while connected with the front cover component by a rotating shaft; the hydraulic driving unit is driven by the water flow in the waterway to drive the front cover component to rotate. The invention drives the whole front cover to rotate by water flow, achieves the rotary sprinkling water; every water spray nozzle on the front cover rotates around the center of the whole front cover instead of its self-center, therefore, the rotation scope of the water flow is relatively larger.

6 Claims, 4 Drawing Sheets

ROTARY-SPRINKLING SHOWER

FIELD OF THE INVENTION

The present invention relates to a shower, especially relates to a rotary-sprinkling shower.

BACKGROUND OF THE INVENTION

The rotary sprinkling from the shower will exert a sideway force to the user's body, so it is more gentle than the vertical sprinkling and has massage function. Furthermore, the shower area of the rotary-sprinkling shower is larger than non-rotary sprinkling shower. Therefore, the rotary-sprinkling shower is more and more popular.

Chinese patent with application number 200520057606.5 discloses a rotary-sprinkling shower, the main principle of said shower is to apply an inclined hole of an inclined water body to generate sideway water streams, and to drive the impeller to rotate, then said impeller drives the impeller sleeve to rotate by an eccentric shaft, then said impeller sleeve revolves around the central axis of the impeller whose rotating radius is the distance between the eccentric cam axis and the impeller central axis, the impeller sleeve does not rotate itself and connected with the top of each water outlet nozzle by sphere surface adaption, each water outlet nozzle is installed in the stepped hole of the front cover, thus the impeller sleeve can drive the water outlet end of the lower position of the each water outlet nozzle swing and rotate, and the water outflow of each water outlet nozzle will rotate to form trumpet-shaped outflow. However, said shower has such shortages: firstly, the rotating area of the rotating outflow of each water outlet nozzle is too narrow, so the expected bath effects can not be realized; secondly, the number of water outlet nozzles is restricted, since if there needs a plurality of water outlet nozzles, the structure of the shower will be too complex, thus it will be difficult for both assembly and manufacture.

Chinese patent with application number 200420070842.6 discloses a shower which can generate rotary sprinkling, its main principle is to install a rotary member on the water outflow body of each water outlet nozzle, said rotary member comprises an impeller and a rotor, said impeller has a water flow conducting board, said rotor has a water outlet nozzle, firstly the water stream strikes the water flow conducting board and drives the impeller rotate, then the impeller will drive the rotor rotate together, finally the water outflow from the water outlet nozzle of the rotor forms the rotary sprinkling. The shortages of said solution is: it is difficult to control the rotating speed; if the water pressure is too weak, it will be difficult to drive the rotating member rotate; if the water pressure is too strong, the rotating speed of the rotating member will be excessive.

SUMMARY OF THE INVENTION

The present invention provides a rotary-sprinkling shower, its main object is to overcome the shortages of the conventional shower wherein the design of the rotary member is not reasonable and the water output area is too narrow to satisfy the requirements of the user; another object of the present invention is to overcome the shortage of the conventional rotary-sprinkling shower whose rotating speed is difficult to be controlled.

The technical solution of the present invention is: a rotary-sprinkling shower, comprising a body, which has a water inlet end and a water outlet end forming a waterway there-between; a front cover component rotatably disposed on the water outlet end of the body, equipped with water spray nozzles in communication with the waterway; a hydraulic driving unit disposed in the waterway, while connected with the front cover component by a rotating shaft; the hydraulic driving unit is driven by the water flow in the waterway to drive the front cover component to rotate.

Said rotating shaft is connected with said hydraulic driving unit by a deceleration mechanism;

Said hydraulic driving unit comprises an inclined water body and an impeller, an inclined hole is disposed on said inclined water body and can generate inclined water stream to drive the impeller to rotate, said deceleration mechanism comprises a planet gear, an outer gear ring and a connecting plate; said impeller, outer gear ring and the connecting plate have a same central line, there is an eccentric cam disposed on said impeller and acts as a planet carrier, such that said eccentric cam, said planet gear and the outer gear ring form a planetary gear train, wherein said eccentric cam is the rotation center of said planet gear, the central line of the outer gear ring is the revolution center of said planet gear, said planet gear is meshed with said outer gear ring; there is a transmission rod eccentrically disposed on said planet gear, and a transmission hole is disposed on said connecting plate, the rotation of the planet gear drives said connecting plate rotate with the cooperation of said transmission rod and the transmission hole, said transmission hole is bigger than the cross-section of the transmission rod such that a movement room is formed, said movement room can allow said transmission rod revolve around the planet gear; the rotating shaft of said front cover component is fixedly connected with said connecting plate.

Said body comprises a down-facing housing and an up-facing supporting covering, the top end of the center of said housing has a water inlet, said supporting covering is installed on the bottom of said water inlet, said hydraulic driving unit and the deceleration mechanism are installed in said supporting covering, said rotating shaft is rotatably installed in the center of said supporting covering and stretches downward, said front cover component is installed on said stretching portion of said rotating shaft.

Said front cover component comprises a front cover and an upper cover, said water spray nozzles are distributed on said front cover fixed on the bottom end of said rotating shaft, said upper cover sleeves on said rotating shaft and locates upon the front cover, a chamber is formed by said upper cover and said front cover, a water communicating hole is disposed on said rotating shaft and communicated between said supporting covering and said chamber, the water inlet of said housing, the supporting covering, the water communicating hole of the rotating shaft, the chamber between said upper cover and said front cover and the water spray nozzles on the front cover form a complete waterway.

Further, a block is disposed on the upper cover of said front cover component, a knob is disposed on said body and connected with a positioning claw, said positioning claw is cooperated with said block to allocate said front cover component.

Besides, said front cover component further has an ornamental side cover which is set between said upper cover and the front cover.

Concluded from the above description of the structure of the present invention, the present invention has such advantages compared with the conventional technique: firstly, the rotary sprinkling is realized by rotating the whole front cover with water stream, each water spray nozzle on the front cover will rotate around the center of the whole front cover instead of rotating around itself; therefore the rotating area of the water outflow is relatively wide; secondly, there is no special needs for the structure of each water spray nozzle, the number of the water spray nozzles will scarcely influence the manufacture cost if the whole structure is complex; thirdly, the planet gear principle is applied between the rotating shaft of the front cover component and the hydraulic driving unit for deceleration, so the rotating speed of the front cover component is controllable and stable.

DETAILED DESCRIPTION OF THE EMBODIMENTS

The present invention will become apparent with the reference of the description of the embodiments and the accompanying drawings.

Figure 1:
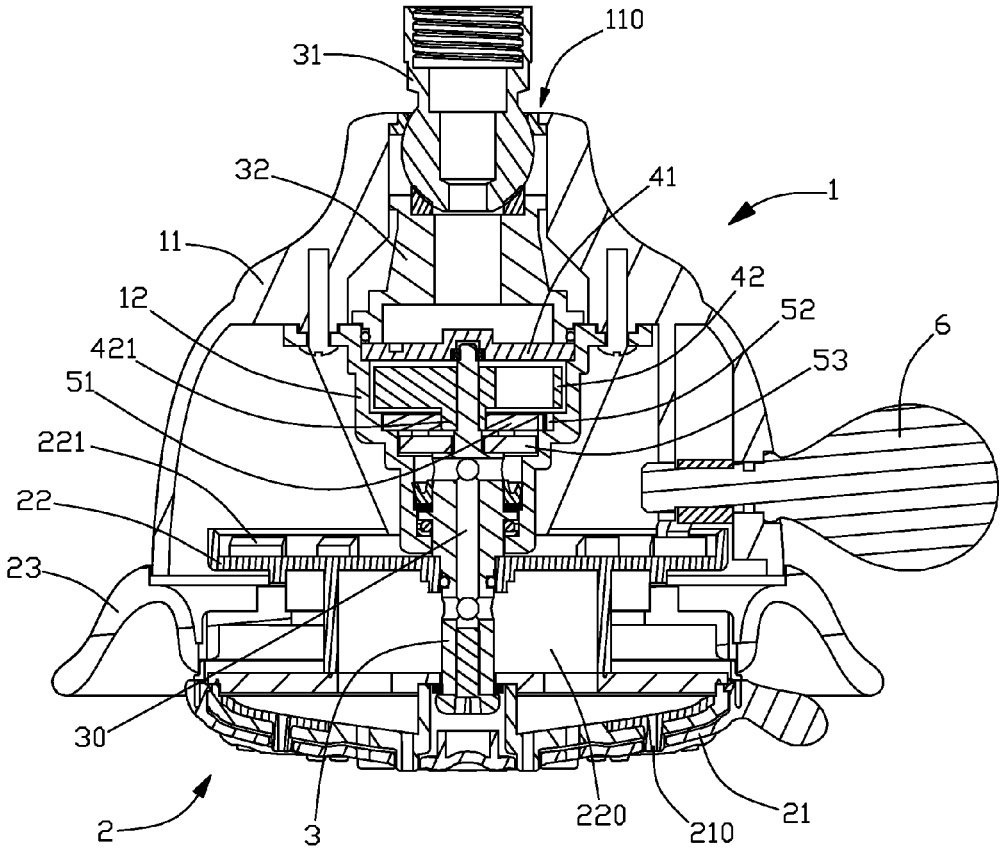
FIG. 1 illustrates the vertical sectional view of the present invention.

Please refer to FIG. 1; the rotary-sprinkling shower of the present invention mainly comprises a body 1, a front cover component 2 and a rotating shaft 3 of the front cover component 2. Said body 1 comprises a down-facing housing 11 and an up-facing supporting covering 12, the top end of the center of said housing 11 has a water inlet 110, said supporting covering 12 is installed on the bottom of said water inlet 110, a joint seat 32 is installed in said water inlet 110, said joint seat 32 is connected with a water inlet joint head 31 by sphere surface adaption.

Figure 2:
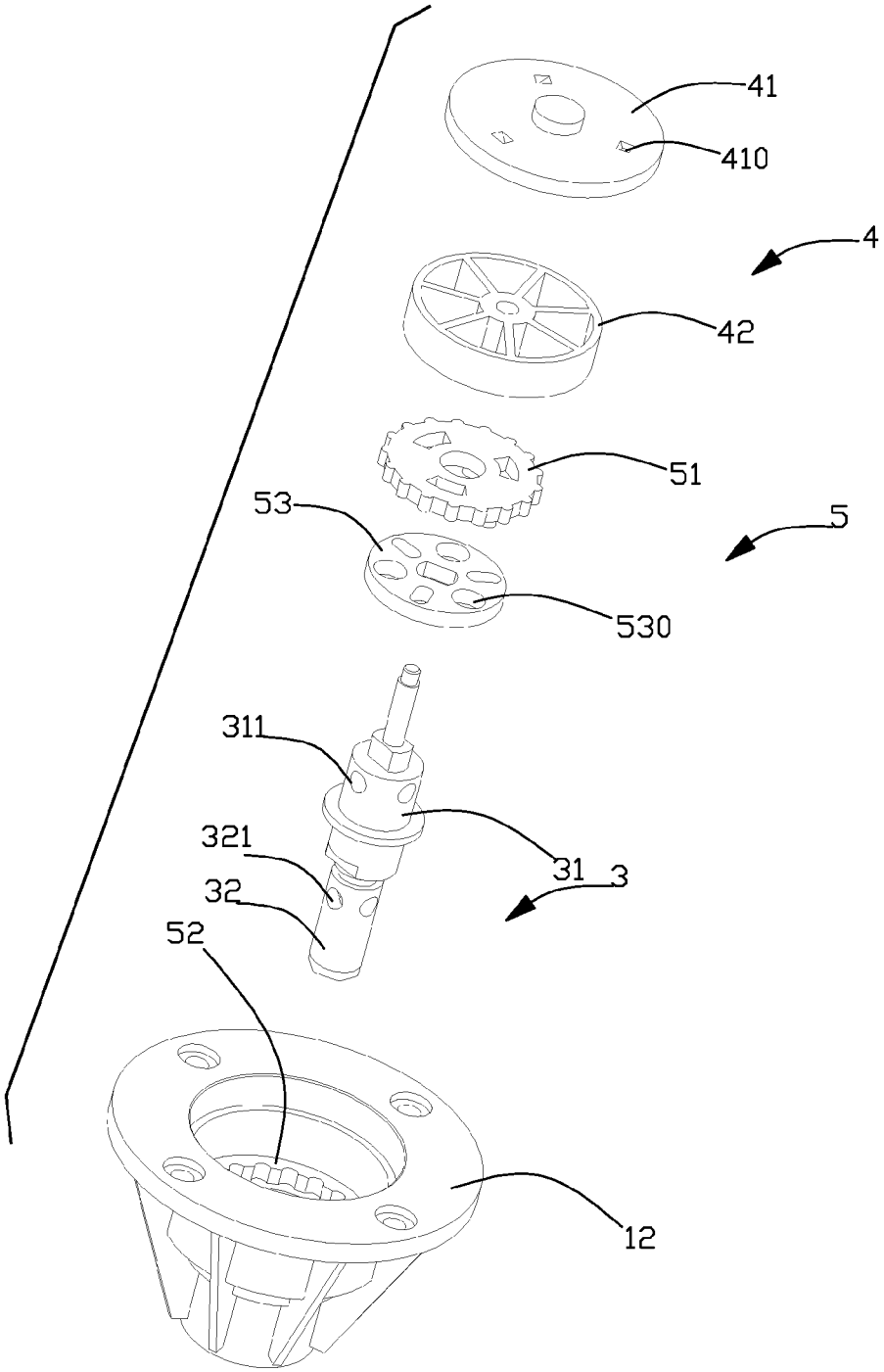
FIG. 2 illustrates the exploded perspective view of the hydraulic driving unit and the deceleration mechanism of the present invention.
Figure 3:
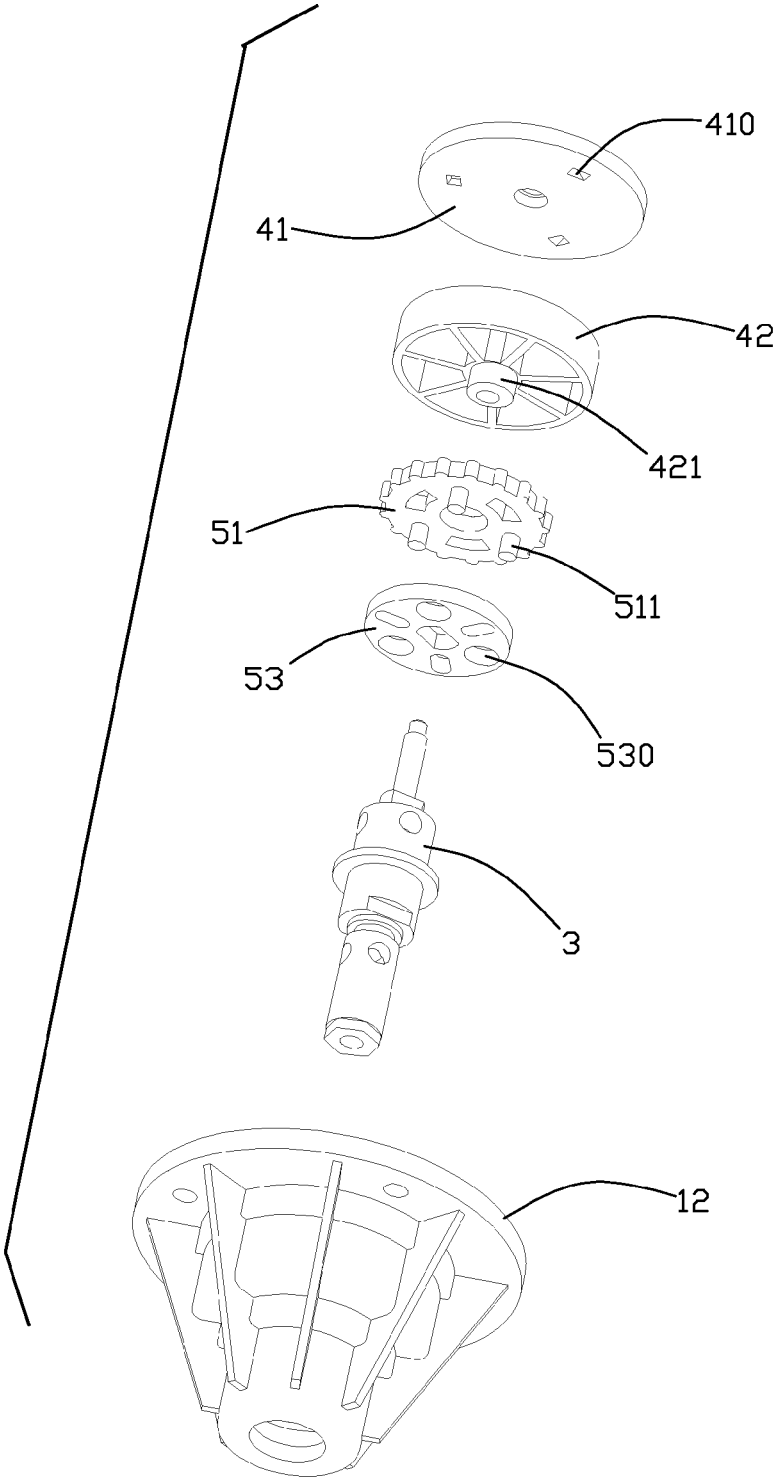
FIG. 3 illustrates the exploded perspective view of the hydraulic driving unit and the deceleration mechanism of the present invention from another view angle.

The hydraulic driving unit 4 and the deceleration mechanism 5 are installed in said supporting covering 12. Please refer to FIG. 2 and FIG. 3, said hydraulic driving unit 4 comprises an inclined water body 41 and an impeller 42, an inclined hole 410 is disposed on said inclined water body 41 and can generate inclined water stream to drive the impeller 42 to rotate, said impeller 42 has an eccentric cam 421.

Said deceleration mechanism 5 comprises a planet gear 51, an outer gear ring 52 and a connecting plate 53. Said impeller 42, outer gear ring 52 and the connecting plate 53 have a same central line. The eccentric cam 421 acts as a planet carrier, such that said eccentric cam 421, said planet gear 51 and the outer gear ring 52 form a planetary gear train, wherein said eccentric cam 421 is the rotation center of said planet gear 51, the central line of the outer gear ring 52 is the revolution center of said planet gear 51, said planet gear 51 is meshed with said outer gear ring 52. A transmission rod 511 is eccentrically disposed on said planet gear 51, and a transmission hole 530 is disposed on the corresponding position of said connecting plate 53, the rotation of the planet gear 51 drives said connecting plate 53 rotate with the cooperation of said transmission rod 511 and the transmission hole 530, said transmission hole 530 is bigger than the cross-section of the transmission rod 511 such that a movement room is formed, said movement room can allow said transmission rod 511 revolve around the planet gear 51.

Please refer to FIG. 1, said joint seat 32 is set between the housing 11 and the supporting covering 12, and said hydraulic driving unit 4 and the deceleration mechanism 5 are set between the joint seat 32 and the supporting covering 12. The outer gear ring 52 is integrated or fixed on the inner peripheral wall of said supporting covering 12.

Figure 4:
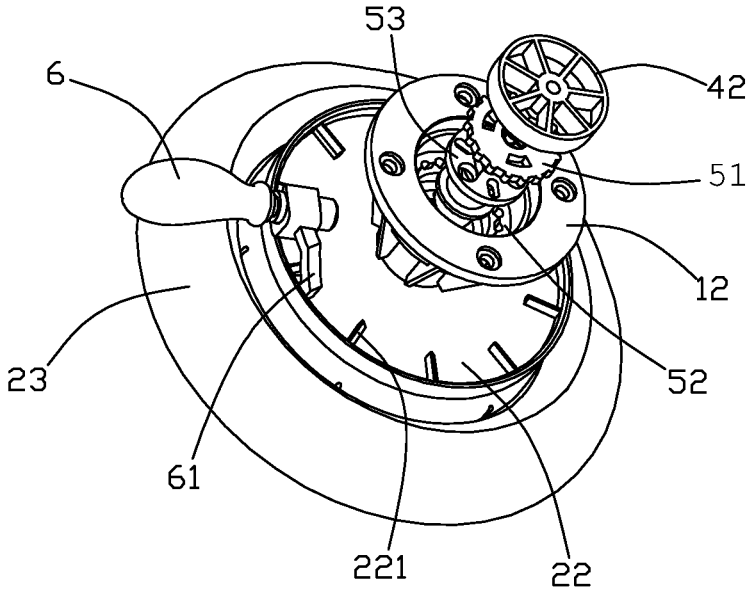
FIG. 4 illustrates the partial exploded view of the present invention when the housing is taken off.

The rotating shaft 3 of said front cover component is rotatably installed on the center position in said supporting covering 12 and fixedly connected with said connecting plate 53, the lower end portion of said rotating shaft 3 stretches downward, said front cover component 2 is installed on the stretching portion of said rotating shaft 3. The upper end of said rotating shaft 3 extends upward as the rotating shaft of the impeller 4, then connected with the central position of said inclined water body 41 with bearing. The rotary shaft 3 is also used as a water passage, a water communicating hole 30 is disposed on said rotating shaft 3 and communicated between said supporting covering 12 and said chamber 220, said rotating shaft 3 has an upper lug boss 31 and a lower lug boss 32, a water inlet nozzle 311 is disposed on the periphery of said upper lug boss 31 and a water outlet nozzle 321 is disposed on the periphery of said lower lug boss 32;

Said front cover component 2 comprises a front cover 21, an upper cover 22 and an ornamental side cover 3, said front cover 21 is fixed on the bottom end of said rotating shaft 3 with bolt, said upper cover 22 sleeves and fixed on said rotating shaft 3 and locates upon the front cover 21, a chamber 220 is formed between said upper cover 22 and the front cover 21, said ornamental side cover 23 is set between said upper cover 22 and the front cover 21 and covers the outside of the upper position of said front cover. Please refer to FIG. 4, a block 221 is disposed on the top surface of said upper cover 22, a knob 6 is disposed on the housing 11 of said body 1 and connected with a positioning claw 61, said positioning claw 61 is cooperated with said block 221 to allocate said front cover component 2. There are water spray nozzles 210 distributed on said front cover 21.

Please refer to FIG. 1, the water inlet 110 of said housing 11 of the body 1, the inner chamber of supporting covering 12, the water communicating hole 30 of the rotating shaft 3, the chamber 220 between said upper cover 22 and said front cover 21 and the water spray nozzles 210 on the front cover 21 form a complete waterway. The water stream flows into the shower body from the joint head 31 and the joint seat 32, then an inclined water stream is generated by the inclined hole 410 of the inclined water body 41 to strike the impeller 42, so the impeller 42 is driven to rotate, then the eccentric cam 421 drives the planet gear 51 revolve around the central axis of the impeller 42 and the outer gear ring 52 by said impeller 42, in the revolution, because the planet gear 51 is meshed with the outer gear ring 52, so the planet gear 51 will rotate around the eccentric cam 421, the rotation of the planet gear 51 drives said connecting plate 53 rotate with the cooperation of said transmission rod 511 and the transmission hole 530, said transmission hole 530 provides a movement room to allow said transmission rod 511 revolve around the planet gear 51. The connecting plate 53 drives the rotating shaft 3 rotate, then the rotating shaft 3 drives the whole front cover component 2 rotate, thus the rotary sprinkling is realized.

Alternatively, the positions of said transmission rod 511 and the transmission hole 530 can exchange, that is, the transmission rod 511 can be disposed on the connecting plate 53, the transmission hole 530 can be disposed on the planet gear 51, such an alternation achieves the same transmission effects as the first embodiment. Although the present invention has been described with reference to the preferred embodiments thereof for carrying out the invention, it is apparent to those skilled in the art that a variety of modifications and changes may be made without departing from the scope of the present invention which is intended to be defined by the appended claims.

INDUSTRIAL APPLICABILITY

The rotary-sprinkling shower of the present invention, which achieves rotary sprinkling by rotating the whole front cover with water stream, each water spray nozzle will rotate around the center of the whole front cover instead of rotating around itself; therefore the rotating area of the water outflow is relatively wide. The structure of the present invention is simple, it is convenient for manufacturing.

What is claimed is:

1. A rotary-sprinkling shower, comprising:

a body, which has a water inlet end and a water outlet end forming a waterway there-between;

a front cover component rotatably disposed on the water outlet end of the body, equipped with water spray nozzles in communication with the waterway;

a hydraulic driving unit disposed in the waterway, while connected with the front cover component by a rotating shaft, said rotating shaft is connected with said hydraulic driving unit by a deceleration mechanism, wherein:

the hydraulic driving unit is driven by water flow in the waterway to drive the front cover component to rotate;

said hydraulic driving unit comprises an inclined water body and an impeller, an inclined hole is disposed on said inclined water body and can generate an inclined water stream to drive the impeller to rotate, said deceleration mechanism comprises a planet gear, an outer gear ring and a connecting plate;

said impeller, outer gear ring and the connecting plate have a same central line, there is an eccentric cam disposed on said impeller which acts as a planet carrier, such that said eccentric cam, said planet gear and the outer gear ring form a planetary gear train, wherein said eccentric cam is the rotation center of said planet gear, the central line of the outer gear ring is the revolution center of said planet gear, said planet gear is meshed with said outer gear ring;

there is a transmission rod eccentrically disposed on said planet gear, and a transmission hole is disposed on said connecting plate, the rotation of the planet gear drives said connecting plate to rotate with the cooperation of said transmission rod and the transmission hole, said transmission hole is bigger than the cross-section of the transmission rod such that a movement room is formed, said movement room can allow said transmission rod to revolve around the planet gear; and the rotating shaft of said front cover component is fixedly connected with said connecting plate.

2. The rotary-sprinkling shower according to claim 1, wherein said body comprises a down-facing housing and an up-facing supporting covering, the top end of the center of said housing has a water inlet, said supporting covering is installed on the bottom of said water inlet, said hydraulic driving unit and the deceleration mechanism are installed in said supporting covering, said rotating shaft is rotatably installed in the center of said supporting covering and stretches downward, said front cover component is installed on said stretching portion of said rotating shaft.

3. The rotary-sprinkling shower according to claim 2, wherein said front cover component comprises a front cover and an upper cover, said water spray nozzles are distributed on said front cover fixed on the bottom end of said rotating shaft, said upper cover sleeves on said rotating shaft and locates upon the front cover, a chamber is formed by said upper cover and said front cover, a water communicating hole is disposed in said rotating shaft and communicates between said supporting covering and said chamber, wherein the water inlet of said housing, the supporting covering, the water communicating hole of the rotating shaft, the chamber between said upper cover and said front cover and the water spray nozzles on the front cover form a complete waterway.

4. The rotary-sprinkling shower according to claim 3, wherein a block is disposed on the upper cover of said front cover component, a knob is disposed on said housing and connected with a positioning claw, said positioning claw is cooperated with said block to allocate said front cover component.

5. The rotary-sprinkling shower according to claim 3, wherein said front cover component further has an ornamental side cover which is set between said upper cover and the front cover.

6. The rotary-sprinkling shower according to claim 3, wherein a middle section of said rotating shaft forms a water passage, said rotating shaft has an upper lug boss and a lower lug boss, a water inlet nozzle is disposed on the periphery of said upper lug boss and a water outlet nozzle is disposed on the periphery of said lower lug boss.

* * * * *